US005165221A

United States Patent [19]

Udelson et al.

[11] Patent Number: 5,165,221

[45] Date of Patent: Nov. 24, 1992

[54] ADJUSTABLE FILM FORMING APPARATUS

[75] Inventors: S. Warren Udelson, Oak Park; David R. Vicik, DesPlaines, both of Ill.

[73] Assignee: Great Lakes Corporation, Chicago, Ill.

[21] Appl. No.: 724,707

[22] Filed: Jul. 2, 1991

[51] Int. Cl.[5] ..... B65B 09/06

[52] U.S. Cl. ..... 53/550; 493/302; 493/439

[58] Field of Search ..... 53/201, 545, 548, 550, 53/551, 552; 493/248, 440, 439, 448, 475, 302, 303, 304

[56] References Cited

U.S. PATENT DOCUMENTS

| | | | |
|---|---|---|---|
| Re. 30,010 | 5/1979 | Shanklin | 53/552 |
| 2,114,621 | 4/1938 | Bergstein . | |
| 2,114,622 | 4/1938 | Bergstein . | |
| 2,376,646 | 5/1945 | Ackerman et al. | 112/138 |
| 2,883,813 | 4/1959 | Shannon | 53/180 |
| 3,007,835 | 11/1961 | Rosenberg et al. | 156/251 |
| 3,011,295 | 12/1961 | Brugger | 53/124 |
| 3,015,601 | 1/1962 | Fener | 156/515 |
| 3,015,920 | 1/1962 | Saumsiegle | 53/44 |
| 3,069,106 | 12/1962 | Shabram | 242/65 |
| 3,070,212 | 12/1962 | Shabram | 198/35 |
| 3,122,466 | 2/1964 | Shabram | 156/515 |
| 3,142,602 | 7/1964 | Shabram | 156/359 |
| 3,191,356 | 6/1965 | Zelnick et al. | 53/182 |
| 3,276,940 | 10/1966 | Shabram | 156/515 |
| 3,312,811 | 4/1967 | Shanklin | 219/388 |
| 3,340,776 | 9/1967 | Shabram . | |
| 3,355,857 | 12/1967 | Tobey | 53/182 |
| 3,411,263 | 11/1968 | Smolderen | 53/28 |
| 3,420,035 | 1/1969 | Deans et al. | 53/182 |
| 3,448,555 | 6/1969 | Shabram | 53/29 |
| 3,490,194 | 1/1970 | Monaghan | 53/28 |
| 3,490,981 | 1/1970 | Shanklin | 156/583 |
| 3,494,096 | 2/1970 | Suzuki | 53/183 |
| 3,513,629 | 5/1970 | Hoagland et al. | 53/182 |
| 3,518,808 | 7/1970 | Solomon | 53/77 |
| 3,552,088 | 1/1971 | Niwa | 53/28 |
| 3,583,888 | 6/1971 | Shanklin | 53/182 |
| 3,619,970 | 11/1971 | Zelnick | 53/30 |
| 3,653,177 | 4/1972 | Adams et al. | 53/182 |
| 3,678,812 | 7/1972 | Wech | 493/440 |
| 3,800,498 | 4/1974 | Suzuki | 53/77 |
| 3,881,296 | 5/1975 | Bate | 53/30 |
| 3,922,958 | 12/1975 | Bate . | |
| 3,952,480 | 4/1976 | Nordstrom | 53/187 |
| 3,974,623 | 8/1976 | Bate | 53/29 |
| 4,003,298 | 1/1977 | Schott, Jr. . | |
| 4,004,400 | 1/1977 | Anderson et al. | 53/182 R |
| 4,016,026 | 4/1977 | Grevich | 156/555 |
| 4,019,307 | 4/1977 | Ballestrazzi et al. | 53/182 R |
| 4,035,983 | 7/1977 | Shanklin et al. | 53/548 X |
| 4,035,984 | 7/1977 | Gerlach et al. | 53/28 |
| 4,060,959 | 12/1977 | Fiedler et al. | 53/373 |
| 4,139,978 | 2/1979 | Jensen et al. | 53/167 |
| 4,185,443 | 1/1980 | Budzyn | 53/550 |
| 4,214,419 | 7/1980 | Allen et al. | 53/543 |
| 4,216,638 | 8/1980 | Yoshida | 156/466 |
| 4,219,988 | 9/1980 | Shanklin et al. | 53/550 |
| 4,244,158 | 1/1981 | Nelham | 53/412 |
| 4,304,561 | 12/1981 | Shingo | 493/439 |
| 4,339,093 | 7/1982 | Shanklin et al. | 242/58.6 |

(List continued on next page.)

*Primary Examiner*—John Sipos
*Assistant Examiner*—Daniel B. Moon
*Attorney, Agent, or Firm*—Marshall, O'Toole, Gerstein, Murray & Bicknell

[57] ABSTRACT

An adjustable film forming apparatus for receiving unfolded film and forming the unfolded film into a tubular form for packaging different sizes of articles. An angled guide rod receives respective portions of the web to form a flat bottom and cooperating with an angled member mounted above the flat bottom forms the top, closed side and opposite open side of the film tube for receiving articles to be packaged. An adjustable film forming table receives the flat bottom portion of the web. Self-positioning means are provided to floatably mount one end of the angled guide rod so as to reposition the guide rod in conformance with changes in the angled member to accommodate different article heights. A side sealer packaging machine with an infeed conveyor, adjustable film forming apparatus, a side sealer, and an end sealer.

9 Claims, 5 Drawing Sheets

U.S. PATENT DOCUMENTS 4,377,061 3/1983 Olson et al. ..... 53/433
4,419,855 12/1983 Shanklin ..... 53/450
4,430,845 2/1984 Dohrendorf ..... 493/302 X
4,447,284 5/1984 Shanklin et al. ..... 156/366
4,494,362 1/1985 Koch ..... 53/550
4,537,016 8/1985 Shanklin et al. ..... 53/493
4,546,597 10/1985 Denker ..... 53/540
4,548,018 10/1985 Wojnicki ..... 53/51
4,608,797 9/1986 Shabram, Jr. et al. ..... 53/550 X
4,704,843 11/1987 Owen et al. ..... 53/540
4,757,893 7/1988 Shabram, Jr. et al. ..... 198/474.1
4,783,950 11/1988 Santagati ..... 53/463
4,924,659 5/5990 Watanabe ..... 53/550
4,939,889 7/1990 Watanabe ..... 53/450
4,967,541 11/1990 Lakey ..... 53/550
4,970,846 11/1990 Leino ..... 53/550

ADJUSTABLE FILM FORMING APPARATUS

This invention relates to film forming apparatus for packaging machinery for packaging articles with thermoplastic heat shrinkable film, and in particular to an adjustable film forming apparatus useful with a side sealer and for packaging different sized articles.

BACKGROUND OF THE INVENTION

Reference may be made to the following U.S. Pat. Nos. of interest: 3,494,096; 3,653,177; 4,216,638; 4,219,988; 4,430,845; 4,494,362; 4,924,659; 4,939,889.

Presently available packaging machines for wrapping articles in a heat shrinkable thermoplastic film incorporate some type of film forming apparatus receiving a sheet of film from a roll and forming the sheet into a generally open tubular form to receive the article. The film tube is then heat sealed around the article with side sealer and end sealer mechanisms in a manner which is appealing to consumers.

Typically, a sheet metal film former conforming to the article being packaged is fabricated of sheet metal plates and is utilized to receive and form the tube of sheet material from the roll. Upon changing of the article size, a new custom-made sheet metal former must be fabricated to accommodate a new sized article so as to form the proper tube of sheet material required for packaging the article. This film forming apparatus requires separate individual custom-made sheet metal film formers for each article size required to be packaged.

Several different systems have been proposed to accomplish film forming for different sized articles. However, such prior systems require substantial adjustments or replacements of components in the packaging machinery, such as adjusting the side sealer mechanism pulling the film through the machinery or require a complete replacement of the film forming mechanism, similar to the custom fabricated film forming units.

Further, it is desired to utilize rolls of unfolded film, rather than rolls of center-folded film, since the rolls of flat unfolded film usually cost substantially less than the rolls of center-folded film. However, in forming the tube of film required to receive the article, many packaging machineries utilize center-folded film, either initially, or incorporating a folding mechanism to convert unfolded film to center-folded film. This, of course, requires additional machinery and increases the cost of the packaging machine.

It is desirable therefore to provide a film forming apparatus which is adjustable to accommodate several different sizes of articles to be packaged, and which can utilize rolls of unfolded plastic film directly without the need to initially form a center-folded sheet from the unfolded film.

SUMMARY OF THE INVENTION

In accordance with the principles of the present invention, there is provided an adjustable film folding apparatus capable of receiving unfolded film and forming the unfolded film into a tubular form for packaging several different sizes of articles without requiring changes in the film forming apparatus. Furthermore, the present invention is particularly useful when utilized with a side sealer mechanism in that the film forming apparatus is adjustable to the side sealer without disrupting the formation of the tubular film required to receive the articles.

In accordance with the present invention, there is provided an adjustable table in the path of the articles being conveyed for packaging, a first guide rod extending along one edge of the table for receiving a web of unfolded film and for guiding a portion of the web onto the film forming table to form the flat bottom of a tube of film for receiving the article. A second guide rod extends angularly from one end of the first guide rod to receive the remaining portion of the web from the film roll.

A film forming angled member is mounted above the table and above the bottom of the tube to receive the remaining portion of the web from the second guide rod. The angled member includes a first film forming section which extends longitudinally along the article path so as to be aligned with one end of the article. A second film forming section extends from the first to define an apex, so that the remaining portion of the web from the second guide rod traverses over the first and second film forming sections and then under the angled member to form the top and closed side of the tube for receiving the article.

A side sealing mechanism receives and pulls both the bottom portion on the film forming table and the top portion from underneath the angled member so that the web is pulled off of the unfolded film roll by the side sealer thereby forming a film tube which has a flat bottom, a top, a closed side adjacent the angled member, and an open side adjacent the side sealer.

Typically, an in-feed conveyor is provided to convey articles being packaged between parallel article guides substantially conforming to the width of the article. In such cases, one of the in-feed conveyor article guides is aligned with the side sealer mechanism and the other article guide is adjusted to conform to the article side opposite the side sealer. In accordance with one aspect of the present invention, an adjustable film forming apparatus is provided such that the film forming table is adjustable across the path of the articles to adjust the angled film forming member mounted to the table so that the first film forming section can be adjusted to conform to the article width being packaged. The closed side of the film tube is thereby adjusted to be aligned with the article side opposite the side sealer. Significantly, such adjustment of the film forming table does not require any adjustments in the first or second guide rods.

In accordance with another aspect of the present invention, the first guide rod is mounted to one edge of the film forming table so as to move therewith and pivotal connection means are used so that the first guide rod can rotatably pivot with respect to the film forming table. The second guide rod, being connected to or an extension of one end of the first guide rod, also moves with the film forming table, and in addition, a floatable mounting is provided for the other or free end of the second guide rod.

Thus, as the film forming table is moved in a transverse position with respect to movement of the article and the web of film, the first and second guide rods not only can pivot, but because of the floatable mounting, the free end of the second guide rod can float and thereby maintain the desired forming angle of the web.

Furthermore, the film forming apparatus of the present invention does not require center-folded film. Accordingly, both an adjustable feature to accommodate different sized articles as well as the feature of utilizing unfolded film directly from the roll are significant advantages of the present invention.

The film former of the present invention can accommodate a variety of article sizes, particularly articles of different height which eliminates the prior requirement for custom-made sheet metal formers for each article. Also, for all of the sizes of articles to be packaged, unfolded film can be used directly from the roll so that no center-folding film apparatus is required.

Accordingly, the present invention provides a significant advantage over prior devices in accommodating a variety of sizes of articles and without requiring center-folded film.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

DETAILED DESCRIPTION

The present invention is described in connection with a side sealer mechanism. While this has distinct advantages, the film forming apparatus of the present invention may be utilized with other types of sealers in packaging machinery. Accordingly, the illustration of the present invention is to provide an example of the invention, and it is to be understood that the invention may as well be applied to other types of packaging machinery.

Figure 5:
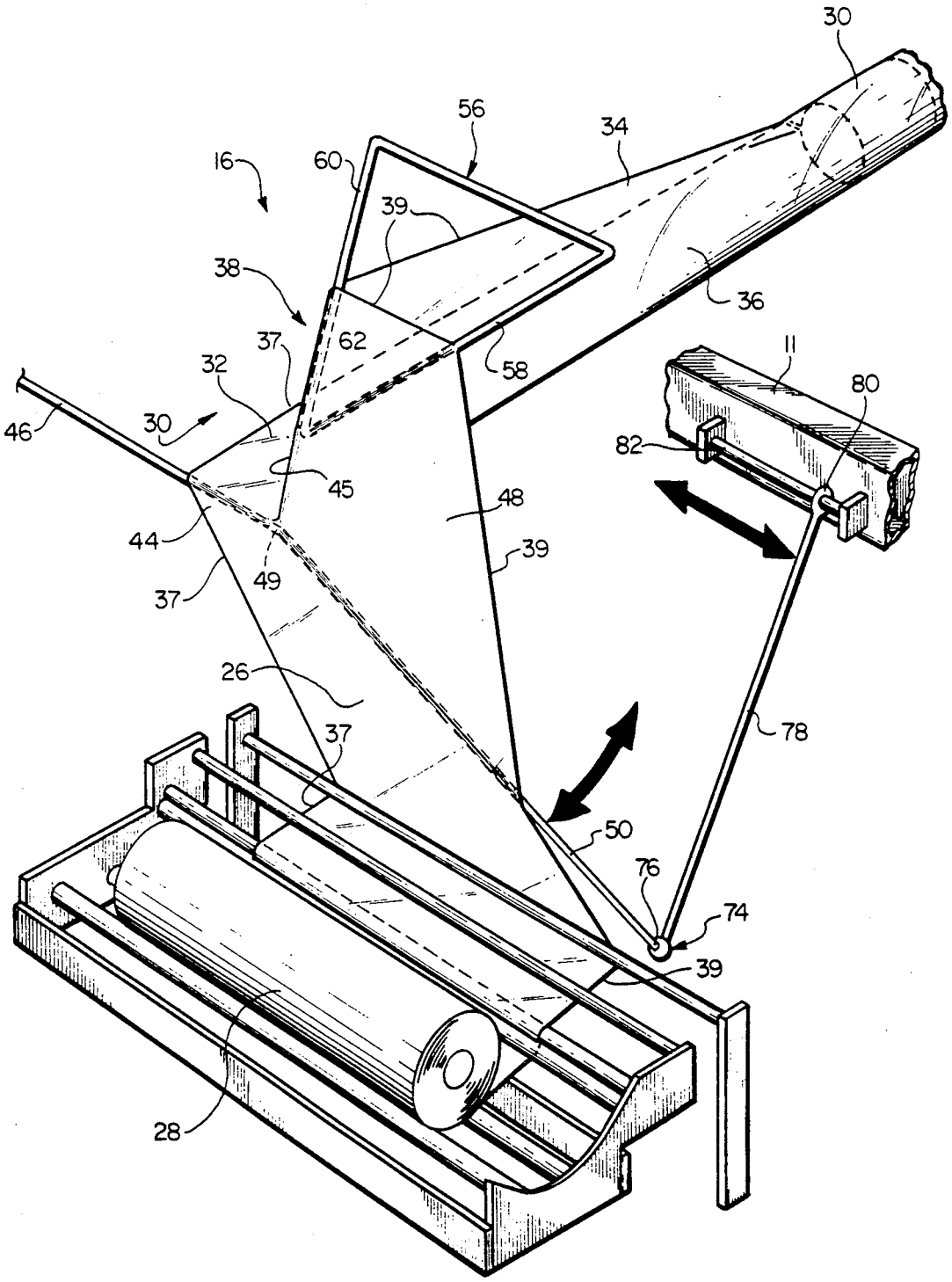
FIG. 5 is a film forming schematic illustrating the unfolded film being transposed into a formed film tube for receiving the articles.

The drawings illustrate a packaging machine 10 for packaging a series of articles 12. The packaging machine includes an in-feed conveyor 14, a film forming apparatus 16, a second conveyor 18, a side sealer mechanism 20, an end sealer mechanism 22, and heating oven 24. The heating oven can be eliminated when heat shrinking is not desired. FIG. 5 shows a web 26 of unfolded film from an unfolded film roll 28 is fed to the film forming apparatus, with roll 28 being mounted to the packaging machine frame below the film former.

Side sealer 20 may be a standard component which as in other side sealing packaging machinery seals the open side of a film tube containing the article. The present invention is directed to film forming apparatus 16 for receiving a web 26 of unfolded film from an unfolded film roll 28, and in accordance with the present invention transforms the web into a formed film tube 30 consisting of a flat bottom 32, a top 34, a closed film tube side 36, and an open tube side 38.

Article 12 is carried on the flat bottom 32; top 34 is formed over the article; open tube side 38 is aligned with side sealer 20; and closed side 36 is formed at the article side opposite the side sealer.

Figure 1:
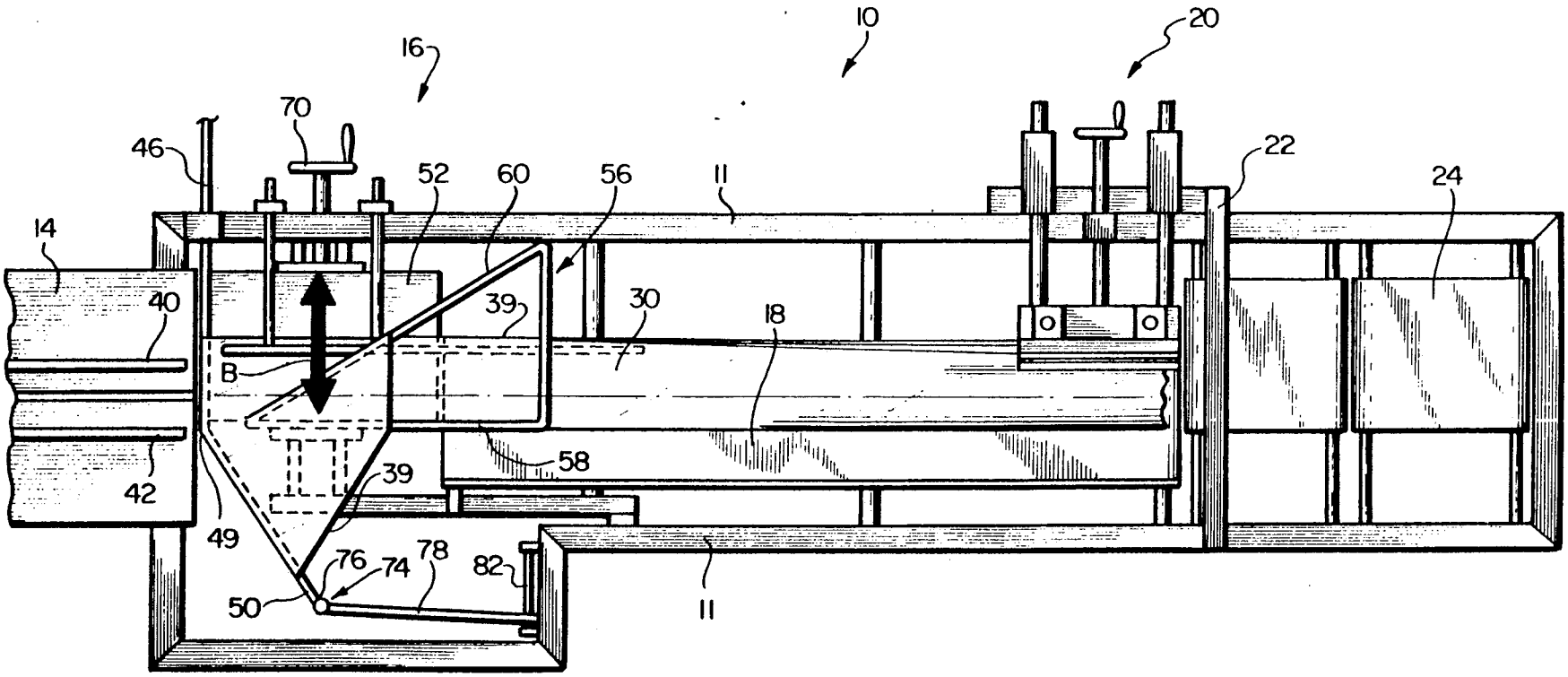
FIG. 1 is a plan view, partly schematic, of a side sealer packaging machine with the improved film forming apparatus of the present, invention.
Figure 2:
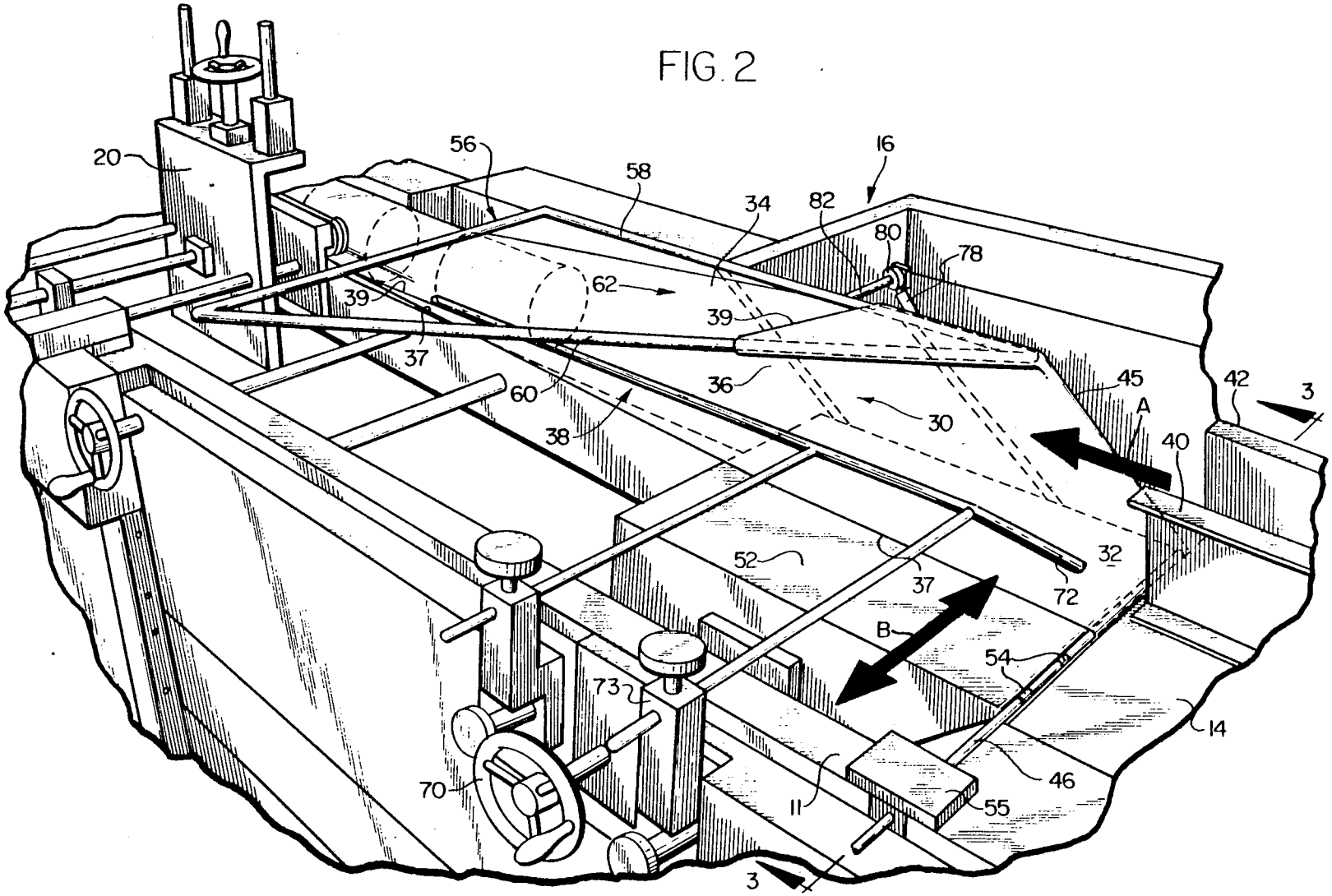
FIG. 2 is a perspective view of a film forming apparatus in accordance with the present invention.

The open side 38 of the film tube with web edges 37, 39 is inserted into side sealer 20 which positively engages and pulls the web from roll 28 and seals side 38. Articles 12 placed on in-feed conveyor 14 are guided by a pair of article guides 40, 42. Both conveyors 14 and 18 are driven by suitable mechanism to directionally move the articles from the in-feed conveyor to the film forming apparatus, to the side sealer, etc., as indicated by directional reference arrow A in FIG. 2. Left article guide 40 is aligned with side sealer 20 so that the open side 38 of the film tube can be sealed by the side sealer immediately adjacent the left side of the article. Right article guide 42 is adjusted to the right side of the article so that the size of the article is accommodated between guides 40, 42. It is understood of course that a conventional in-feed conveyor may be utilized for conveyor 14 with article guides 40, 42.

At the end of in-feed conveyor 14, the article is inserted into formed film tube 30 formed by film forming apparatus 16. In accordance with the present invention and with reference to FIG. 5, a first portion 44 of unfolded film web 26 from roll 28 is passed over first guide rod 46 and the remaining portion 48 of web 26 is passed over a second guide rod 50. Guide rod 50 is shown as an angled extension from end 49 of guide rod 46.

Figure 3:
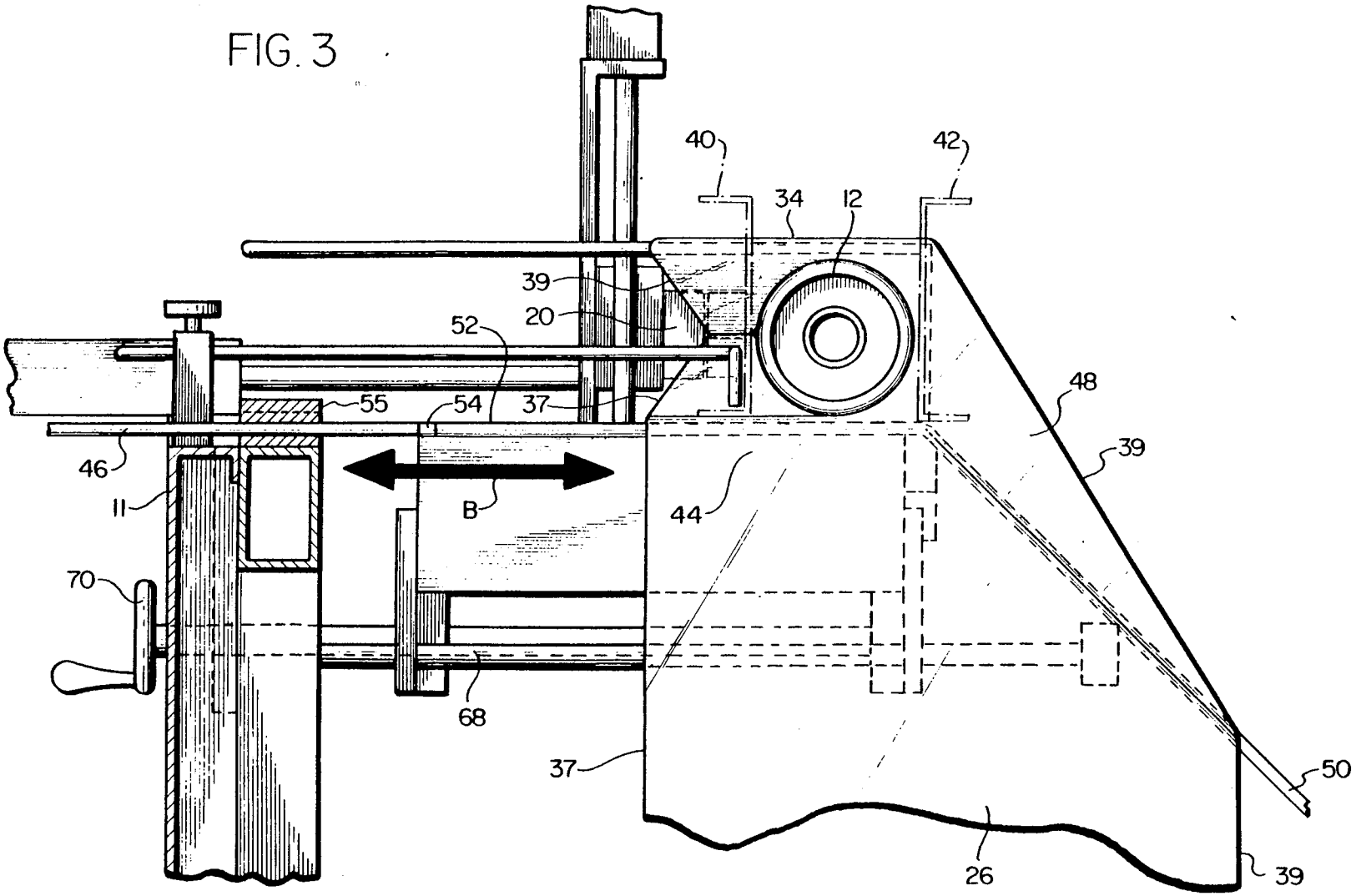
FIG. 3 is a sectional view taken along line 3—3 of FIG. 2 illustrating positioning of the film forming table with respect to the side sealer and the angled member.

Guide rods 46, 50 are pivotally mounted to a film forming table 52 so that they move with the table and can pivot with respect thereto. Pivotal connection means 54 are provided between first guide rod 46 and table 52 (see FIG. 3) and a bearing mount 55 between rod 46 and machine frame 11 enables the rod to pivot and move with the table.

An angled film forming member 56 in the form of a triangle shaped member includes a first film forming guide section 58 and a second film forming section 60 at an angle to section 58 with an apex 62 defined therebetween. Angled film forming member 56 is positionably mounted above table 52 by a suitable adjustable mounting means such as the illustrated mounting blocks 64 and mounting rods 66. By slidably positioning mounting rods 66 in mounting blocks 64 along the directional reference arrow C, angled member 56 is moved in parallel to the top of table 52.

As shown in FIG. 5, web 26 extends over first guide rod 46 to form the flat bottom 32 of the formed film tube on table 52. The remaining portion 48 of web 26 extends over second guide rod 50, over angled member 56 (i.e., over the angle formed by guide sections 58, 60), then under member 56 to form the top and sides of film tube 30. A film forming line 45 is provided between apex 62, and end 49 of guide rod 46 as shown in FIG. 5.

Film forming table 52 is mounted to frame 11 on a suitable carriage 68 with handwheel 70 so that table 52 can be moved transversely across the path of article 12 as shown by the directional reference arrow B. An article guide bar 72 is adjustably supported in position by mounting posts 73 to frame 11 to guide articles 12 from in-feed conveyor 14 into the opening of film tube 30.

The angle between mounting rods 66 and table 52 (see FIG. 4) is preferably formed to be the same as the angle between guide sections 58 and 60 so that the remaining portion 48 of web 26 can smoothly traverse over and under angled member 56. Note that this desired angular relationship is maintained during the parallel, positional adjustments of angular member 56 with respect to the top of table 52 so that apex 62 always moves along reference line 63 (FIG. 4) which is the same as the forming line 45 (FIG. 5) of web 26. Forming line 45 is therefore maintained at a constant angle equal to the angle between guide sections 58 and 60 during positional adjustments of angled member 56.

In a constructed embodiment of the present invention, the following relationships were utilized:

1. Angle formed between guide sections 58 and 60 is 35.26 degrees;

2. Angle formed between rods 66 and the top of table 52 is 35.26 degrees; and 3. Angle formed between the axis of guide rod 46 and extension guide rod 50 is 45 degrees.

In setting up the machine operation, article guide 40 is adjusted in line with the sealing portion of side sealer 20. Article guide 42 is adjusted to conform to the article width size. Web 26 is then pulled up from the unfolded film roll over guides 46, 50 and over and under angled member 56 to form the film tube 30. Open side 38 of the film tube with web edges 37 and 39 is inserted into the side sealer. Table 52 is adjusted to position film forming section 58 so that closed film tube side 36 is located adjacent the respective article side opposite the side sealer. Rods 66 are adjusted within mounting blocks 64 to adjust the height of angled member 56 so that top 34 of the film tube is suitable for the height of article 12. Article guide bar 72 mounted to frame 11 is then suitably adjusted in line with article guide 40 and with respect to side sealer 20.

The machinery can now be operated so that the articles are inserted into formed film tube 30; open side 38 with web edges 37 and 39 is sealed by side sealer 20; and the end portions of the tube are correspondingly sealed by end sealer 22. If desired, the plastic may then be subjected to heating oven 24 for heat shrinking the package onto the article in a manner well-known in the art.

Different sized articles can be readily accommodated by film forming apparatus 16 of the present invention. As an example, if the new article is of the same height but is of a different width from the prior article, one need only adjust article guides 40 and 42, the position of table 52, article guide bar 72, conveyor 18, and side sealer 20 to position the article in the center of the machinery in order to reliably package the new articles.

If the new articles are of the same width but are slightly higher than the prior articles, then only an adjustment of mounting rods 66 on mounting blocks 64 need be accomplished in order to adjust the height of angled member 56 above table 52.

Figure 4:
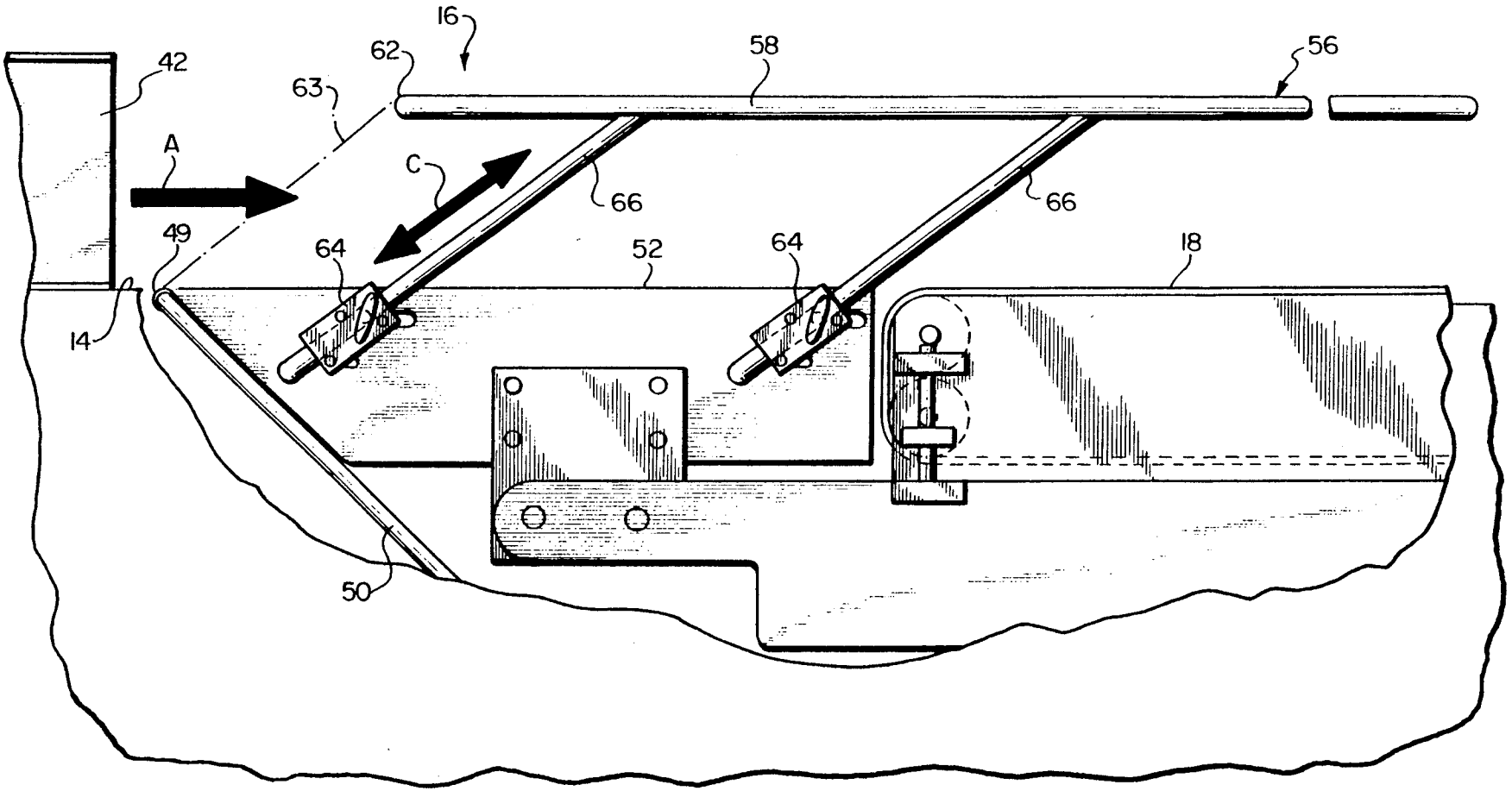
FIG. 4 is a fragmentary side elevational view illustrating the adjustment of the angled member for article heights.

With reference to FIG. 4, it can be seen that increasing the height of angled member 56 above table 52 moves apex 62 upwardly and away from guide rods 46, 50 which normally would require manual repositioning of guide rod 50 to place the proper amount of remaining portion 48 of web 26 onto angled member 56. An important feature of this invention is that manual repositioning of rod 50 is not required as self-positioning means are provided for rod 50.

In this connection it may be noted that self positioning means for rod 50 is provided by a floating point connection 74 at free end 76 of rod 50. Floating point connection 74 permits rods 46, 50 to pivot so as to maintain the proper traversing of a desired amount of web 26 on angled member 56 when the angled member 56 is moved to a new position. Floating point connection 74 is provided by a float rod 78 having one end connected at floating point connection 74 by a rod end bearing to the free end 76 of rod 50, and another end pivotally connected to the machinery frame. As illustrated in FIG. 5, a sliding pivot connection 80 formed by a rod end bearing connects one end of float rod 78 to a fixed rod 82 mounted to the frame. Also, as forming table 52 is moved, guide rods 46 and 50 pivot by means of the floating point connection 74 at free end 76.

If the height of new articles is changed drastically from prior articles being packaged, mounting rods 66 can be shortened or lengthened by adding or deleting additional suitable threaded rod sections so as to raise or lower the height of angled member 56 above forming table 52. Thus, as an example, articles having ranges in height between 1/8 inch to 8 inches can be accommodated by using suitable rods of length 2 inches, 6 inches, 12 inches and 16 inches.

Accordingly, the present invention provides an adjustable film former apparatus for packaging machinery which can accommodate a variety of package sizes and which can use material directly from a roll of unfolded film.

The foregoing detailed description has been given for clearness of understanding only, and no unnecessary limitations should be understood therefrom, as modifications will be obvious to those skilled in the art.

What is claimed is:

1. In packaging machinery for packaging articles in thermoplastic film fed as a web from a roll of film, the improvement of film forming apparatus adjustable to accommodate different sizes of articles into a formed film tube having a flat bottom, an opposite top, a closed tube side and an open tube side comprising:

a first guide rod for receiving one portion of the web of film at a guide end of said first guide rod and forming a flat bottom of the film tube;

a film forming table;

means for mounting said first guide rod at one end of said table so as to feed said formed flat bottom from said first guide rod to a top surface of said film forming table;

a second guide rod extending at an angle from said guide end of said first guide rod to a floating end to guide the remaining portion of said web into a position above said formed flat bottom;

an angled member mounted to said film forming table for movement therewith, said angled member and then under said angled member to form said opposite top and said closed tube side of said film tube;

means for adjustably positionably locating said film forming table transversally with respect to said formed tube flat bottom to accommodate packaging articles of different width; and self-positioning means for floatably mounting said second guide rod floating end to enable said second guide rod to pivot as said film forming table is adjustably positioned for packaging articles of different width so as to maintain a desired amount of remaining portion of said web to be fed to said angled member.

2. The improvement of claim 1, wherein a film forming line is provided between said apex and said guide end of said first guide rod and at a film forming line angle to said table top surface, and means for providing said film forming line angle of said film forming line to said table top surface to be substantially equal to said apex angle between said first and second film forming sections of said angled member.

3. The improvement of claim 2, including means for adjustably positioning said angled member above said table top surface so that said film forming line angle and said apex angle are maintained substantially equal during said positioning.

4. A side sealer packaging machine readily adjustable for packaging articles of different height and width in thermoplastic film fed as a web from a roll of film comprising:

an in-feed conveyor for conveying said articles;

film forming apparatus for receiving said articles and adjustable to accommodate different sized of articles into a formed film tube having a flat bottom, an opposite top, a closed tube side and an open tube side, said film forming apparatus including, a first guide rod for receiving one portion of the web of film at a guide end of said first guide rod and forming a flat bottom of the film tube;

a film forming table;

means for mounting said first guide rod at one end of said table so as to feed said formed flat bottom from said first guide rod to a top surface of said film forming table for receiving articles from said in-feed conveyor;

a second guide rod extending at an angle from said guide end of said first guide rod to a floating end to guide the remaining portion of said web into a position above said formed flat bottom;

an angled member mounted to said film forming table for movement therewith, said angled member disposed above said formed flat bottom and having an apex adjacent said guide end, said apex defined by a first film forming section extending longitudinally along said film tube and a second film forming section extending at an apex angle to said first film forming section, said remaining portion of said web transversing from said second guide rod initially over said angled member and then under said angled member to form said opposite top and said closed tube side of said film tube;

means for adjustably positionably locating said angled member above said formed flat bottom to accommodate packaging articles of different height;

means for adjustably positionably locating said film forming table transversally with respect to said formed tube flat bottom to accommodate packaging articles of different width;

self-positioning means for floatably mounting said second guide rod floating end to enable said second guide rod to pivot as said film forming table is adjustably positioned and to pivot in response to said adjustable positioning of said angled member so as to maintain a desired amount of remaining portion of said web to be fed to said angled member;

a side sealer for receiving and heat sealing said open tube side; and and end sealer for heat sealing the ends of said formed film tube around said respective article.

5. The improvement of claim 4, wherein a film forming line is provided between said apex and said guide end of said first guide rod and at a film forming line angle to said table top surface, and means for providing said film forming line angle of said film forming line to said table top surface to be substantially equal to said apex angle between said first and second film forming sections of said angled member.

6. The improvement of claim 5, including means for adjustably positioning said angled member above said table top surface so that said film forming line angle and said apex angle are maintained substantially equal during said positioning.

7. In packaging machinery for packaging articles in thermoplastic film fed as a web from a roll of film, the improvement of film forming apparatus adjustable to accommodate different sizes of articles into a formed film tube having a flat bottom, an opposite top, a closed tube side and an open tube side comprising:

a first guide rod for receiving one portion of the web of film at a guide end of said first guide rod and forming a flat bottom of the film tube;

a film forming table;

means for mounting said first guide rod at one end of said table so as to feed said formed flat bottom from said first guide rod to a top surface of said film forming table;

a second guide rod extending at an angle from said guide end of said first guide rod to a floating end to guide the remaining portion of said web into a position above said formed flat bottom;

an angled member mounted to said film forming table for movement therewith, said angled member disposed above said formed flat bottom and having an apex adjacent said guide end, said apex defined by a first film forming section extending longitudinally along said film tube and a second film forming section extending at an apex angle to said first film forming section, said remaining portion of said web transversing from said second guide rod initially over said angled member and then under said angled member to form said opposite top and said closed tube side of said film tube;

means for adjustably positionably locating said angled member above said formed flat bottom to accommodate packaging articles of different height; and self-positioning means for floatably mounting said second guide rod floating end to enable said second guide rod to pivot in response to said adjustable positioning of said angled member to accommodate packaging articles of different height so as to maintain a desired amount of remaining portion of said web to be fed to said angled member.

8. The improvement f claim 7 including means for moving said angled member parallel with respect to the to surface of said film forming table.

9. The improvement of claim 7, including means for adjustably positionably locating said film forming table transversally with respect to said formed tube flat bottom to accommodate articles of different width.

* * * * *